United States Patent [19]

Oaks

[11] 4,037,834

[45] July 26, 1977

[54] JOGGING DEVICE

[76] Inventor: Arthur Q. Oaks, 432 Spring St., Cambridge Springs, Pa. 16403

[21] Appl. No.: 605,998

[22] Filed: Aug. 20, 1975

[51] Int. Cl.[2] ..... A63B 5/00

[52] U.S. Cl. ..... 272/65; 272/70; 272/109

[58] Field of Search ..... 272/65, 66, 76, 83 R, 272/70, 109; 5/111, 241, 242, 247, 248, 253, 254, 255, 256, 263; 182/139

[56] References Cited

U.S. PATENT DOCUMENTS

| | | | |
|---|---|---|---|
| 2,122,531 | 7/1938 | Millward | 5/263 X |
| 3,347,546 | 10/1967 | Abberly | 272/65 |
| 3,641,601 | 2/1972 | Sieg | 272/65 X |
| 3,767,009 | 10/1973 | Sidlinger | 272/65 X |

*Primary Examiner*—Richard C. Pinkham
*Assistant Examiner*—William R. Browne
*Attorney, Agent, or Firm*—Edward J. Quirk

[57] ABSTRACT

A jogging device comprises a padded completely rigid platform freely suspended with and by a frame by a dual spring arrangement. The frame has an upper curved surface to which a cantilever spring is attached; the cantilever spring is in series with a coil extension spring which is attached to the platform.

6 Claims, 4 Drawing Figures

JOGGING DEVICE

BACKGROUND OF THE INVENTION

During the past several years, jogging has become a particularly popular national pastime. People have become aware of potential health problems associated with lack of proper exercise, and special emphasis has been placed on working of the cardiovascular system. Jogging has grown to be a preferred type of exercise, since leg and arm muscles, in addition to the heart, are worked. Indeed, many physicians recommend jogging, with various degrees of strenuousness, to patients who have had cardiac problems.

Since the benefits from exercise such as jogging appear only when the exercise is faithfully repeated, a person must develop a habit or routine of exercise at least several times a week. In most cases, jogging is a difficult activity to fit into a regular routine. For example, running in the rain or snow, or intense heat, may be unpleasant and indeed dangerous. City dwellers may have to travel some distance to find a track or park suitable for jogging. Accordingly, many people begin a jogging routine with good intentions to continue, but find that the habit soon breaks down, and eventually disappears. Therefore, it is useful to have a device which can assist people to perform a jogging-type exercise in their home, and which is inexpensive and easily stored.

Indoor jogging devices have been proposed in the past. For example, Garcia, U.S. Pat. No. 3,628,791 discloses a jogging aid having a pair of foot pedals which are adjustably biased to support persons of different weights. The pedals are hinged at the front, and are depressed at the rear by the jogger when in use. This device is somewhat confining to the runner, since he must keep one foot on each pedal. In addition, the handrail could be easily bumped or kicked by a jogger in full stride.

A board for in-place jogging is shown in Childers, U.S. Pat. No. 3,634,895. This board consists of a piece of plywood supported by a layer of foam rubber to provide a degree of resilience to the board. The plywood is carpeted to provide a non-skid surface for the runner. Since all of the resiliency of the board is attributed to the foam, the amount which the board can "give" on any single impact is quite limited, particularly for a relatively small person.

Accordingly it is an object of the present invention to provide an in-place jogging device which is relatively inexpensive and attractive, and which is constructed to provide substantial platform movement for joggers of widely varying weights.

It is another object of the invention to provide a jogging platform having a spring construction which partially self-adjusts the travel of the board to the force applied to the board, providing good jogging action over a wide range of applied forces.

SUMMARY OF THE INVENTION

A jogging device comprises an enclosed tubular frame having a curved upper surface, a rigid padded platform resiliently suspended within said frame, and spring means comprising in series a flat cantilever spring and a relatively stiff extension coil spring, one end of the cantilever spring being attached to the curved upper surface of the frame and one end of the coil spring being attached to the frame.

DETAILED DESCRIPTION OF THE INVENTION

Figure 1:
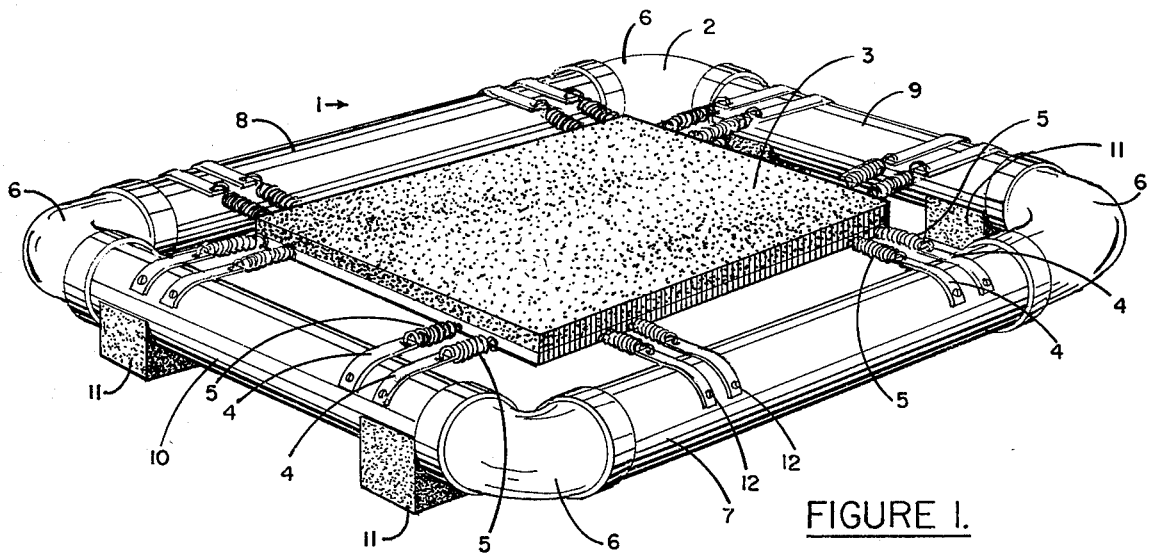
FIG. 1 is a top perspective view of a jogging device of the invention.

Referring to FIG. 1, jogging device 1 comprises continuous rectangular frame 2 from which rigid platform 3 is suspended by a plurality of spring means consisting of a flat cantilever spring 4 and coil extension spring 5. The frame consists of four straight lengths of ABS plastic pipe, schedule 40, having an inside diameter of about 3 inches and an outside diameter of about 3½ inches, connected by four identical ABS plastic pipe elbows 6. The frame is slightly rectangular, with opposing pipe lengths 7 and 8 being about 27 inches from elbow to elbow, and lengths 9 and 10 being about 23 inches. The device may of course be made larger or smaller, or of a different shape, if desired.

The frame is supported by four feet 11 fabricated from the same type of foam rubber as the platform pad. The feet consist of 3 inches cubic blocks, with the top part cut to fit the contour of the bottom of the frame. The feet lift the frame approximately two inches from the floor, allowing clearance for greater extension of the springs toward the floor if the jogging device is being used by a heavy person, or if particularly active jogging is taking place. The feet are located just inside of the elbows on opposing sides of the frame, and are attached with standard rubber cement. The feet also keep the device from skidding when in use, prevent the device from marring the floor, and help absorb additional shock.

The key to the excellent action provided by the jogging device is the fact that the platform is rigid and is suspended from a dual-acting spring system. The outer spring 4 is a cantilever slat spring having a length of 4 inches, a width of about five-eighths inch, and a thickness of about 0.032 inch. The spring is made from SAE 1,075 carbon steel, Rockwell 38–43C hardness, which is heat-treated after forming (No. 3 temper). The cantilever spring is attached to the frame with conventional sheet metal screws 12 at a point approximately 1 inch around the circumference from the top of the frame member. By attachment in this manner, the spring extends over the apex of curvature of the pipe. The screw is offset from the top of the pipe in order to minimize the direct tension of the spring on the screw, and also to provide maximum cantilever effect of the spring.

The inner portion of the spring suspension consists of coiled extension spring 5, about 3⅛ inches in length, having a spring characteristic of 45 lbs tension at maximum extension. The spring has hook-like ends 15 and 16 for mounting; hook 15 extends through orifice 17 at the inner end of the cantilever spring, and hook 16 engages spring hanger 18 which is attached to the underside of the platform. Both the cantilever and coil springs are cadmium plated for attractive appearance and for corrosion resistance.

Figure 3:
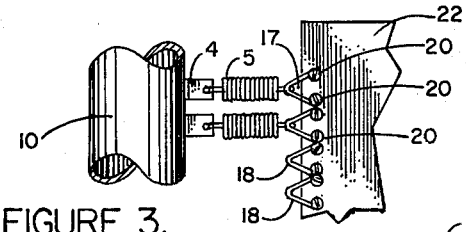
FIG. 3 is a partial bottom view of the device, showing the method of attaching the spring to the platform.

The spring hangers are best seen in FIG. 3, which is a partial bottom view of the device. Spring hangers 18 consist of essentially V-shaped heavy wires made from 0.071 spring steel. Spring steel is used rather than a softer steel to prevent the spring from wearing through the hanger. The inner ends of the hangers are curved and are attached to the bottom of the plywood platform with screws 20. Extra spring hangers are shown in FIG. 3 for addition of extra springs in case a very heavy person is using the device, or in case a very rigid effect is desired.

The jogging device is shown with four sets of springs on each side of the platform; this arrangement appears to be optimum for all but very heavy persons who use the device quite actively. The springs are importantly located relatively near the corners of the platform, such that when the user's foot lands near to a corner of the platform, the springs offer more resistance in that area and therefore permit less tipping of the platform. This provides a substantial advantage over jogging devices having a flexible woven fabric as a platform; these devices tend to have a non-uniform bounce which will throw the user off-balance.

The platform consists of $\frac{5}{8}$ inch plywood base 22, having dimensions of 21 × 24 inches, covered with a pad 23 of closed cell soft foam rubber, having a thickness of from about $\frac{3}{4}$ to $1\frac{1}{4}$ inches, preferable about 1 inch. Closed cell foam is preferred to open-cell foam since it provides faster rebound to the original shape. The plywood provides a rigid, stable feel to the surface, whereas the foam relieves the impact of the user's feet on the hard surface, providing a comfortable cushion and also adding a small amount of resilience to the jogging device. The foam is attached to the plywood with any conventional adhesive. The foam pad may optionally be covered with standard indoor/outdoor carpet to provide better wear characteristics to the surface.

Figure 2:
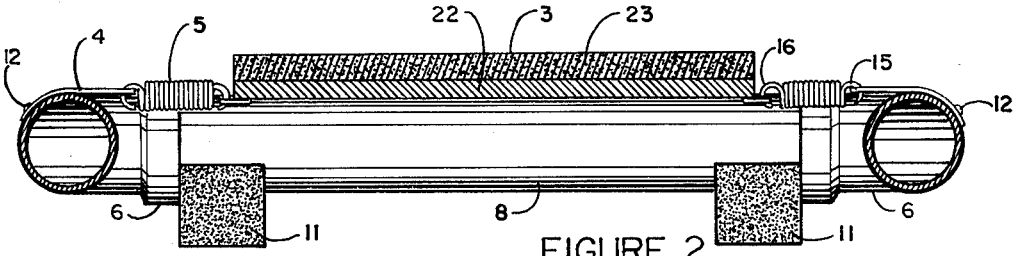
FIG. 2 is a sectional side view of the device, the section being taken down the center of the device.
Figure 4:
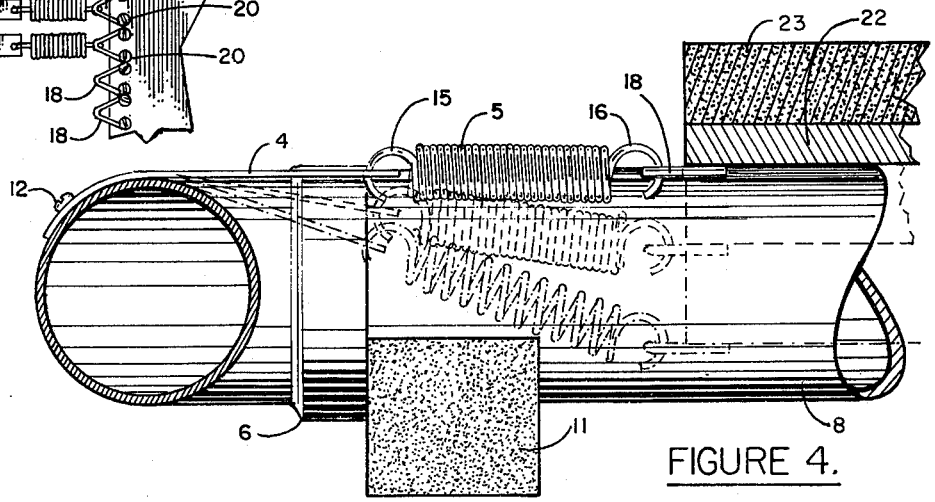
FIG. 4 is a partial side section indicating the action of the springs at various force levels on the platform.

The ability of the springs to handle users having widely different weights, and to adjust to light or heavy jogging, is illustrated in FIG. 4. The no-load position is shown in solid lines; this position is also shown in FIGS. 1 and 2. As moderate downward force is exerted on the platform, the cantilever spring bends around the pipe frame 10, with little or no effect on the stiff coil spring. This status is shown in the intermediary phantom position of FIG. 4. During very light jogging, or when lightweight persons such as children are using the device, the platform will rarely descend below this level. Nevertheless, the resiliency of the cantilever spring allows for active jogging under these light loads.

As the force on the platform increases, the cantilever spring reaches the approximate limit of its extent of travel, and the coil spring begins to extend, as shown in the bottom phantomed position in FIG. 4. The stiffer coil spring is able to withstand very strong forces without allowing the platform to extend to the floor. The double spring action therefore provides efficient shock reduction at widely varying forces on the platform, and provides relatively constant action for users of differing weights when compared to jogging devices supported only by coil springs.

Assembly of the jogging device is quite simple. The pipe pieces are fit together with rubber cement in a jig to assure that the frame is straight and level. Templates are used to place the holes for the sheet metal screws and, if desired, for the handrail. The plywood platform is held in a press for drilling of the spring anchor mounting guide holes, and the rubber pad and carpet are cemented to the platform and trimmed to size. The spring hangers are then attached to the bottom of the platform. Cantilever springs are then attached to the frame with screws. The platform is mounted on the frame by handing one end of the extension spring onto the cantilever spring, and the other end onto the spring hanger on the platform.

Various modifications and additions to the device are possible. For example, a handrail attachment may extend upwardly from the frame to provide balancing assistance if necessary. In this case, the handrail is mounted through holes placed in the flanges of pipe elbows 6 extending along one or more sides of the frame. In addition, many variations in materials of construction and dimensions are possible within the spirit and scope of the invention, the heart of which is the unique spring construction for a rigid platform jogging device. Accordingly, the scope of the invention should be considered limited only by the following claims.

I claim:

1. A jogging device comprising a frame having an arcuate upper surface, a horizontal completely rigid jogging platform freely suspended within and by same frame, means for yieldingly mounting the platform within the frame comprising a plurality of spring means, each of said spring means comprising in series combination a cantilever spring and a coil spring, said cantilever spring being attached to the arcuate upper surface of the frame and extending inwardly toward the platform, and said coil spring having one end thereof attached to the inward portion of the cantilever spring and the other end thereof attached to the platform.

2. The jogging device of claim 1 wherein the cantilever springs comprise slat springs which are attached to the outer periphery of the arcuate upper frame surface such that the spring extends over the apex of the frame curvature and inwardly toward the platform.

3. The jogging device of claim 1 also comprising fastening means for attaching the cantilever spring to the frame, and fastening means for attaching the coil spring to the platform.

4. The jogging device of claim 1 also comprising a plurality of resilient feet mounted on the underside of the frame and adapted to support the frame in a level, horizontal position.

5. The jogging device of claim 1 wherein the cantilever spring and the coil spring have relative spring characteristics such that as increasing downward force is exerted on the platform from an unstressed condition, the cantilever spring bends substantially to its limit prior to the coil spring having substantial extension.

6. The jogging device of claim 1 wherein the rigid platform is covered with a pad of closed-cell soft foam rubber having a thickness of from about $\frac{3}{4}$ to about $1\frac{1}{4}$ inches.

* * * * *